United States Patent [19]

Palmatier

[11] Patent Number: 5,016,530

[45] Date of Patent: May 21, 1991

[54] INK MOVER DISTRIBUTOR ROLL

[75] Inventor: Roland T. Palmatier, Durham, N.H.

[73] Assignee: Harris Graphics Corporation, Dover, N.H.

[21] Appl. No.: 430,878

[22] Filed: Nov. 2, 1989

[51] Int. Cl.[5] ..... B41F 31/00

[52] U.S. Cl. ..... 101/349; 101/148

[58] Field of Search ..... 101/348, 148, 349, 350, 101/367, 207, 208; 29/127, 128; 118/256, 258

[56] References Cited

U.S. PATENT DOCUMENTS

| | | | |
|---|---|---|---|
| 1,568,401 | 1/1926 | Griffith | 29/127 |
| 1,756,308 | 4/1930 | Schmidt | 101/349 |
| 2,369,814 | 2/1945 | Worthington | 101/350 |
| 3,462,053 | 8/1969 | Behr | 29/127 |
| 3,613,575 | 10/1971 | Kantor | 101/148 |
| 3,877,368 | 4/1975 | Madigan | 101/348 |
| 4,750,422 | 6/1988 | Gysin | 29/127 |

FOREIGN PATENT DOCUMENTS

| | | | |
|---|---|---|---|
| 0729860 | 3/1966 | Canada | 37/249 |

*Primary Examiner*—Edgar S. Burr
*Assistant Examiner*—C. A. Bennett
*Attorney, Agent, or Firm*—Tarolli, Sundheim & Covell

[57] ABSTRACT

An ink distributor roll is made of base rubber and two soft rubber helixes. When the ink distributor roll is used adjacent another roll, the soft rubber helixes deform to form pockets between the ink distributor roll and the other roll. The pockets move ink from the end portions of the ink distributor roll toward the center portion of the roll to prevent a buildup of ink at the end portions of the roll.

8 Claims, 1 Drawing Sheet

INK MOVER DISTRIBUTOR ROLL

BACKGROUND OF THE INVENTION

This invention relates to an inker for a printing press, and particularly relates to an improved ink distributor roll for use in an inker for a printing press.

DESCRIPTION OF THE PRIOR ART

In an offset printing press ink is transferred from an ink fountain to ink train rolls by a ductor roll. The ink train rolls transfer the ink to form rolls which transfer the ink to a printing plate or the like on a plate cylinder. The printing plate transfers the ink to a blanket cylinder which transfers the ink to the material to be printed.

While the ink is being transferred from one roll to another roll, the ink tends to build up on the ends of at least certain rolls outside the printing area. The ink on the ends of a roll may be slung off of the roll and wasted and/or causes ink globs to develop on the blanket cylinder and/or the material being printed. The material being printed, typically a paper web, may stick to the ink globs on the blanket cylinder and thus may tear.

SUMMARY OF THE INVENTION

The present invention relates to the transfer of ink between first and second inker rolls in a manner which tends to avoid the build up of ink on the ends of the rolls. The rolls define a nip therebetween at which ink is transferred from the first roll to the second roll. One of the rolls includes means for pumping a small amount of ink from the opposite ends of the roll toward the center of one roll as the first and second rolls rotate. The means for pumping ink comprises an outer peripheral surface portion of the roll in which pockets form in response to the fluid pressure at the nip. The pockets pump the ink from the opposite ends of the one roll as the first and second rolls rotate.

The present invention preferably is an ink distributor roll which is made of a base rubber or rubber-like material for example. The roll has two rubber or rubber-like helixes of a durometer hardness less than the hardness of the base rubber. When the ink distributor roll is adjacent another roll, the softer rubber helixes move a small amount of ink from the opposite end portions of the ink distributor roll toward the center portion of the roll. Thus, the ink outside the printing area is kept in circulation and the formation of ink globs on the ends of the roll is minimized.

The soft rubber helixes deform due to the fluid pressure between the two rollers to form pockets at the nip between the two rollers. The pockets trap ink and move the ink from the opposite end portions of the ink distributor roll toward the center portion, thus, minimizing a buildup of ink on the end portions.

BRIEF DESCRIPTION OF THE DRAWINGS

The foregoing and other objects and features of the present invention will become more apparent upon a consideration of the following description taken in connection with the accompanying drawings wherein.

DESCRIPTION OF A PREFERRED EMBODIMENT

Figure 1:
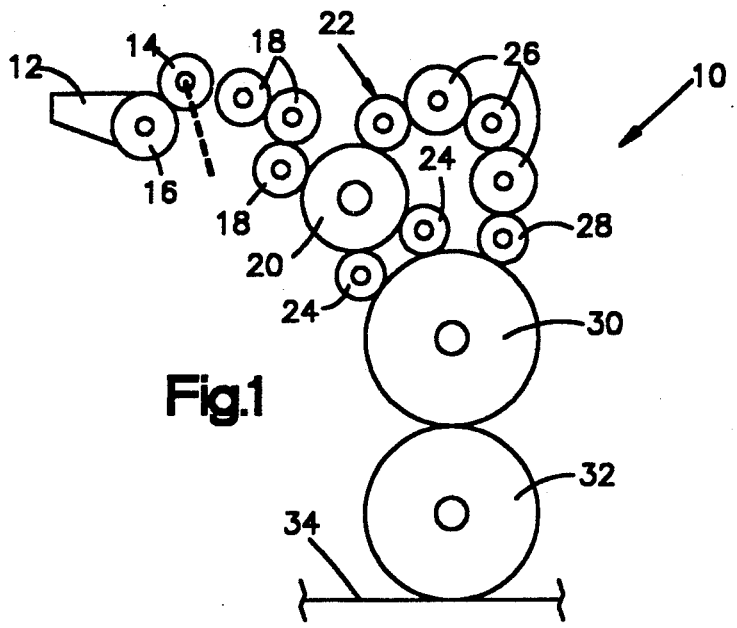
FIG. 1 is a schematic drawing of a printing apparatus incorporating the present invention.

A printing apparatus 10 incorporating the present invention is illustrated in FIG. 1. The printing apparatus 10 includes an ink fountain 12 and a fountain roll 16. A ductor roll 14 picks up ink from the fountain roll 16. The ductor roll 14 transfers ink to ink train rolls 18 which transfer ink to an intermediate roll 20. Intermediate roll 20 transfers ink to an ink distributor roll 22 and to form rolls 24. The ink distributor roller 22 transfers ink to one of a plurality of intermediate rolls 26 which transfer ink to a form roll 28. The form rolls 24 and 28 transfer ink to a printing plate or the like on a plate cylinder 30. The printing plate contains the image to be printed which is transferred to a blanket cylinder 32. The blanket cylinder 32 transfers the ink image to the material 34 to be printed, such as a paper web. Any of the rolls in the inker may be constructed in accordance with the present invention. In the present embodiment, however, roller 22 is constructed in accordance with the present invention.

Figure 2:
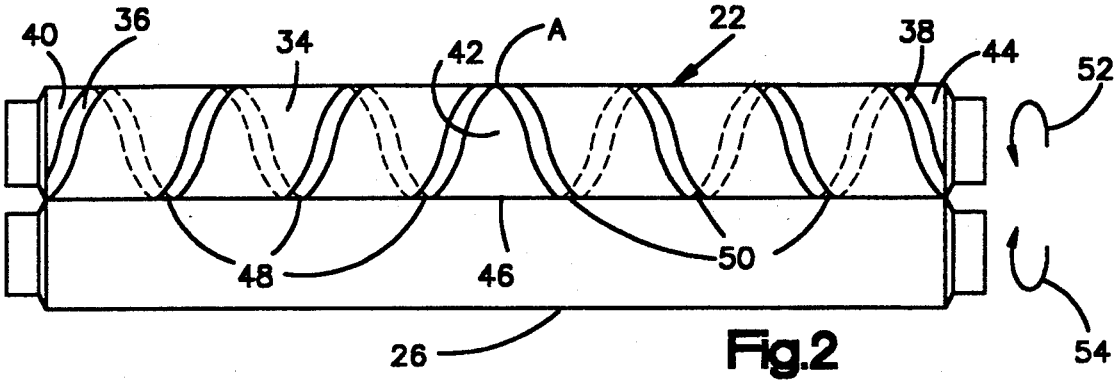
FIG. 2 is a plan view of an ink distributor roller constructed in accordance with the present invention located adjacent another roller of the printing apparatus of FIG. 1.
Figure 3:
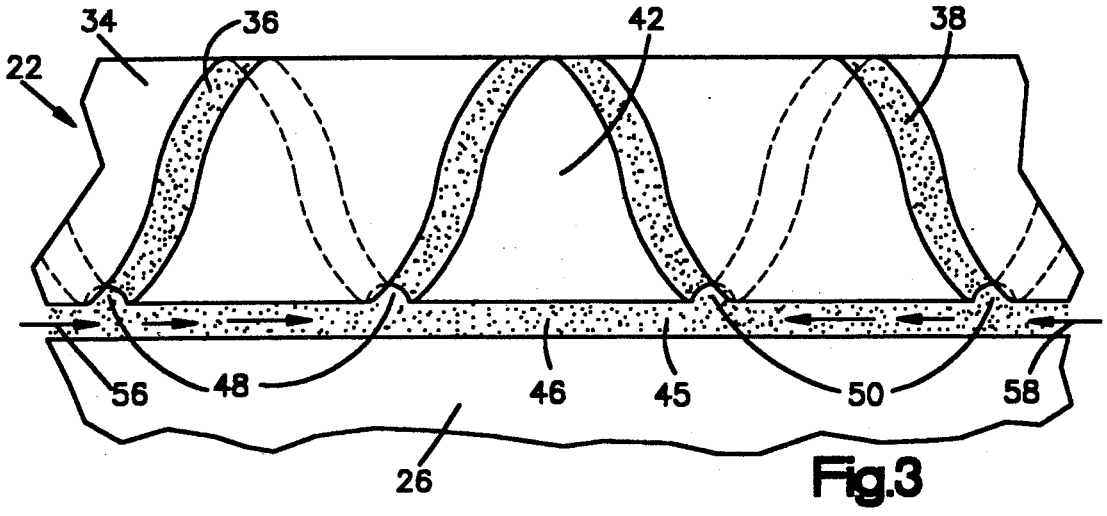
FIG. 3 is an enlarged fragmentary view illustrating the manner in which pockets are formed between an ink distributor roller of the patent invention and an adjacent roller.

The improved ink distributor roller 22 is illustrated in FIGS. 2 and 3. The roller 22 has a base rubber portion 34 having a predetermined durometer hardness and rubber helical insets 36 and 38 having a durometer hardness less than the durometer hardness of the base rubber portion 34. The diameters of the portion 34 and the helical insets 36, 38 are equal.

Helical inset 36 extends around the circumference of roller 22 and axially from the end portion 40 of the roll 22 towards the center portion 42 of the roll. The helical inset 38 extends around the circumference of the roll 22 and axially from the end portion 44 towards the center portion 42 of the roll 22. The helical insets 36 and 38 may meet approximately in the center portion 42 of the roll 22 and form an acute angle therebetween at A. The helical insets do not have to meet in the center, but may cover only some end portions of the roll.

During operation of the printing apparatus when the ink distributor roller 22 is adjacent the roller 26 (FIG. 3) an ink film 45 is located in the nip 46 between the two rollers. This is shown in exaggerated form in FIG. 3. Due to the fluid pressure between rolls 22 and 26 at the nip 46, the helical insets 36 and 38 deform at the nip 46 to a greater extend than the hard rubber portion 34. Pockets 48 and 50, for example, are thus formed in the helical insets 36, 38. The pockets 48 and 50 trap ink therein.

The pockets 48 and 50 are formed at axially spaced locations along the nip 46 at one time as the roll 22 rotates in the direction of arrow 52 (FIG. 2) and the roll 26 rotates in the direction of arrow 54. Pockets are also formed at the nip between the roll 22 and the roll 20. The pockets 48 and 50 are formed axially closer to the center portion 42 at another time during the rotation of the rollers 22 and 26. The pockets 48 (FIG. 3) appear to move in the direction of arrows 56 and pockets 50 appear to move in the direction of arrows 58 as the rolls 22 and 26 rotate. The helical insets 36 and 38 are sloped from end portions 40 and 44 of the roll 22, respectively, toward the center portion 42 so that when the roll 22 rotates in the direction of arrow 52 the pockets 48 and 50 appear to move axially from the end portions 40 and 44 toward the center portion 42.

The formation of the pockets 48 and 50 at different axial locations at different times causes ink to be pumped from the end portions 40 and 44 toward the center portion 42. Thus, ink near the ends is kept in circulation and prevented from building up on the ends of the roll 22 and 26. Ink is not slung from the rolls 18 through 28 and ink globs do not form which may be transmitted to the blanket cylinder 32 or material 34. Ink globs on the blanket cylinder 32 or material 34 can cause the material 34 to stick to the blanket cylinder 32 and tear. The present invention minimizes this possibility.

The durometer of the rubber portion 34 and the durometer of the helical inset 36, 38 may vary. The softer the helical insets are the larger are the pockets and thus the greater is the flow of ink from the end portions of the roll 22 toward the center of the roll. Also, one skilled in the art upon reading the present application will appreciate that changes and modifications may be made therein. It is intended to cover all such changes and modifications that come within the scope of the appended claims.

Having described a preferred embodiment of the invention, I claim:

1. Apparatus for use in a printing press, said apparatus comprising first and second rotatable inker rolls defining a nip therebetween at which ink is transferred between said rolls under pressure as said rolls rotate, said first roll having opposite ends, a center between said ends, and means for moving ink from said opposite ends toward said center as said rolls rotate, said means for moving ink comprising an outer peripheral surface portion of said first roll in which pockets form in response to said pressure at said nip, said pockets moving said ink from said opposite ends of said first roll toward said center of said first roll as said rolls rotate, whereby said means for moving ink reduces ink build-up at said opposite ends of said first roll.

2. Apparatus as set forth in claim 1 wherein said first roll has an axis, said outer peripheral surface portion comprising a first helical inset extending around said first roll and axially from one of said ends, and a second helical inset extending oppositely around said first roll and axially from the other of said ends, said pockets forming in said insets.

3. Apparatus as set forth in claim 2 wherein said first roll is rotatable about an axis, said nip being parallel to said axis and having a center between said ends of said first roll, individual ones of said pockets being formed at certain locations spaced axially from said center of said nip at one time in the rotation of said first and second rolls, and being formed axially closer to said center of said nip at a later time in the rotation of said first and second rolls.

4. Apparatus as defined in claim 2 wherein said first and second helical insets have terminal ends which meet at said center of said first roll.

5. Apparatus as set forth in claim 2 wherein said first roll has a cylindrical base portion formed of a rubber or rubber-like material having a predetermined durometer hardness, said insets are rubber or rubber-like material elements having a durometer hardness less than said predetermined durometer hardness, and the outer diameters of said base portion and said insets are approximately equal.

6. Apparatus for use in a printing press, said apparatus comprising:

first and second inker rolls;

means for supporting said first and second inker rolls for rotation, and to define an elongated nip at which ink is transferred under pressure between said rolls upon rotation of said rolls, said nip having a first end, a second end, and a center between said ends; and means for moving ink from said ends of said nip toward said center of said nip, said means comprising deformable roll surface portions in which pockets form in response to said pressure at said nip, said pockets including first pockets which move lengthwise along said nip in a direction from said first end toward said center upon rotation of said rolls, and second pockets which move lengthwise along said nip in a direction from said second end toward said center upon rotation of said rolls, said first and second pockets respectively remaining on opposite sides of said center.

7. Apparatus as defined in claim 6 wherein said first roll has a first end, a second end, a center between said ends, a first helical surface portion in which said first pockets are formed, and a second helical surface portion in which said second pockets are formed, said first and second helical surface portions being located on opposite sides of said center of said first roll.

8. Apparatus for use in a printing press, said apparatus comprising an ink moving roll to transfer ink to another roll at a nip therebetween, said ink moving roll having opposite ends, a center between said ends, and means for pumping ink in directions from said ends toward said center as said ink moving roll rotates, said means for pumping ink comprising surface portions of said ink moving roll in which pockets form in response to ink pressure on said surface portions, which pockets pump ink from said ends of said ink moving roll toward said center of said ink moving roll as said ink moving roll rotates, said surface portions including a first helical surface portion for forming first pockets which pump ink in a first direction, and a second helical surface portion for forming second pockets which pump ink in a second direction opposite to said first direction, said first and second pockets respectively remaining on opposite sides of said center of said ink moving roll.

* * * * *